US006926569B1

(12) United States Patent
Hsieh

(10) Patent No.: US 6,926,569 B1
(45) Date of Patent: Aug. 9, 2005

(54) FIN WITH A BLADE HAVING ADJUSTABLE CLOSED AREA

(76) Inventor: Hsing-Chi Hsieh, No.51, Wan An Street, Taipei (TW)

( * ) Notice: Subject to any disclaimer, the term of this patent is extended or adjusted under 35 U.S.C. 154(b) by 0 days.

(21) Appl. No.: 10/777,416

(22) Filed: Feb. 11, 2004

(51) Int. Cl.[7] ..... A63C 31/08
(52) U.S. Cl. ..... 441/64
(58) Field of Search ..... 441/64

(56) References Cited

U.S. PATENT DOCUMENTS 2,701,222 A * 2/1955 Hetzel et al. ..... 156/66
3,335,441 A * 8/1967 Wolfe ..... 441/103
5,586,368 A * 12/1996 Nelson ..... 24/390

* cited by examiner

*Primary Examiner*—Sherman Basinger
(74) *Attorney, Agent, or Firm*—Pro-Techtor International Services

(57) ABSTRACT

A fin includes a blade, which is lengthwise split into a plurality of sub-blades, so that the sub-blades are separated from one another from an outer end of the blade to a near central point of the blade; and at least one zipper, which is located between two adjacent sub-blades and adapted to zip up for the adjacent sub-blades to provide a closed area. The closed area provided by the adjacent sub-blades is adjustable by zipping up the zipper by different length to thereby regulate a propulsive force that may be produced by the blade of the fin.

7 Claims, 6 Drawing Sheets

FIN WITH A BLADE HAVING ADJUSTABLE CLOSED AREA

FIELD OF THE INVENTION

The present invention relates to a fin with a blade having adjustable closed area, and more particularly to a fin with a blade having a closed area that may be freely adjusted for the blade to create desired propulsive force matching a diver's kick force.

BACKGROUND OF THE INVENTION

A fin includes a blade that has an expanded area to produce enhanced water-kicking ability and propulsive force, so as to help a user, that is, a diver, to quickly move forward under water.

Generally, a fin has given specification and size. The propulsive force that can be produced by a fin is determined by the hardness of the material used to make the fin and the water-kicking force produced by the diver. Generally speaking, a fin having a blade made of a harder material tends to produce larger propulsive force. However, the diver must be strong enough to exert more strength to kick water with the harder blade. On the other hand, a blade made of a softer material tends to produce somewhat smaller propulsive force, and the diver may kick water with the softer blade without exerting too much strength. That means the diver may reserve more energy for swimming under water.

The blade of a fin is typically a solid flat piece, and has a performance decided by the material used to make the fin. However, the same type fin might have different users, and the same user or diver might need different fins for different diving environments or water activities. A conventional fin has given hardness that could not be changed once the fin is produced. That is, the conventional fin is not adapted to different users or different use conditions because it could not be changed in the hardness thereof, and accordingly the propulsive force that may be produced by it.

To solve the above problems, a fin with a blade having a plurality of lengthwise channels is developed. Elongated inserts may be separately inserted into the channels, so that the blade may have an overall hardness and accordingly a propulsive force adjustable by the number of the elongated inserts inserted in the channels on the blade.

The elongated inserts are separated from the fin and normally disorderly scattered when they are not inserted in the channels on the blade, and are therefore easily getting lost. Particularly, these elongated inserts are not always available for use when they are normally scattered, and not conveniently portable when they are temporarily removed from the channels on the blade. Although the above-mentioned elongated inserts are useful in adjusting the hardness of the fin, they are not convenient for use.

U.S. Pat. No. 5,746,631 discloses a fin having a left and a right blade, most part of which are separated from each other. However, since the left and the right blade are always in the separated state, they do not have the function of providing an adjustable closed area thereof.

SUMMARY OF THE INVENTION

A primary object of the present invention is to provide a fin that includes a blade, which is lengthwise split into a plurality of sub-blades, so that the sub-blades are separated from one another from an outer end of the blade to a near central point of the blade; and at least one zipper, which is located between two adjacent sub-blades and adapted to zip up for the adjacent sub-blades to provide a closed area. The closed area provided by the adjacent sub-blades is adjustable by zipping up the zipper by different length to thereby regulate a propulsive force created by the blade of the fin.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
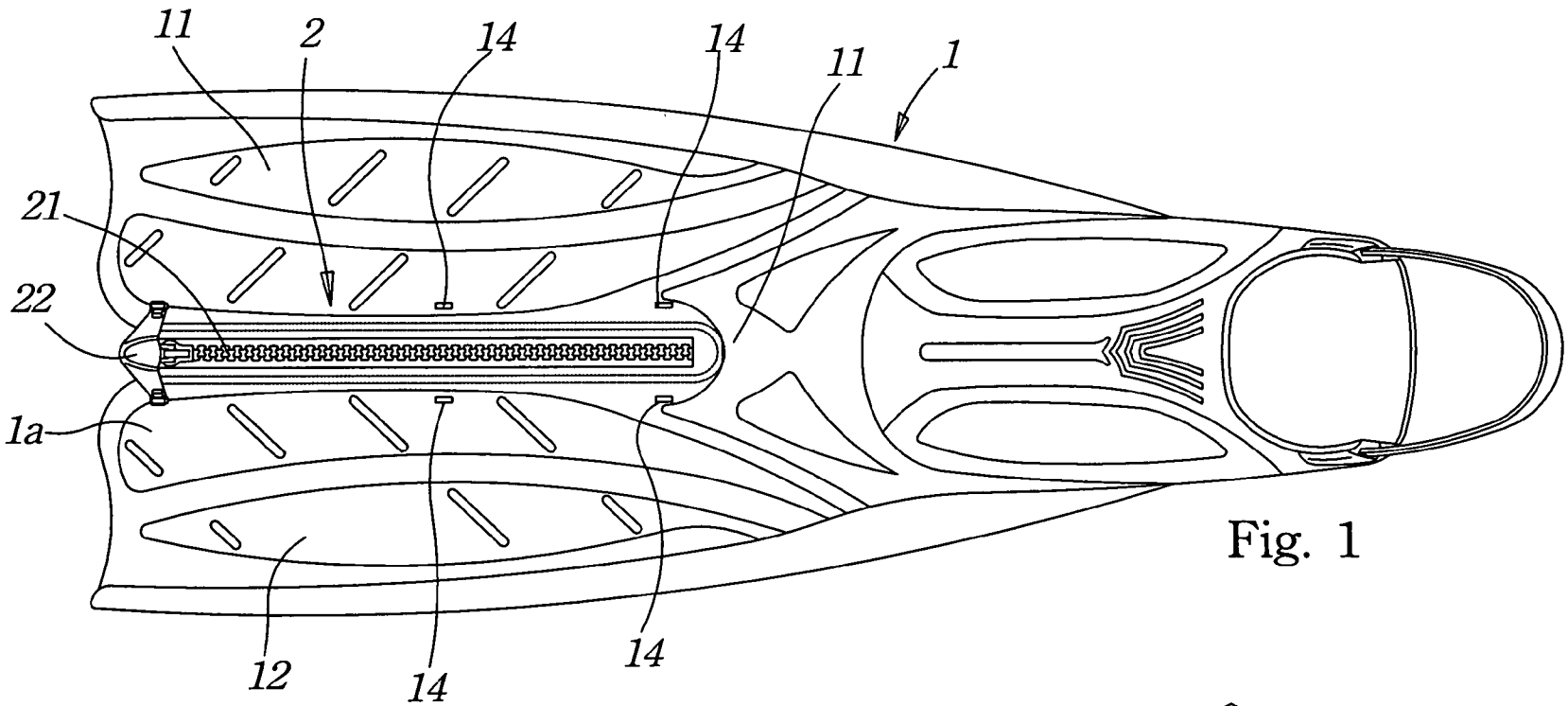
FIG. 1 is a top plan view of a fin with a blade having adjustable closed area according to the present invention.
Figure 2:
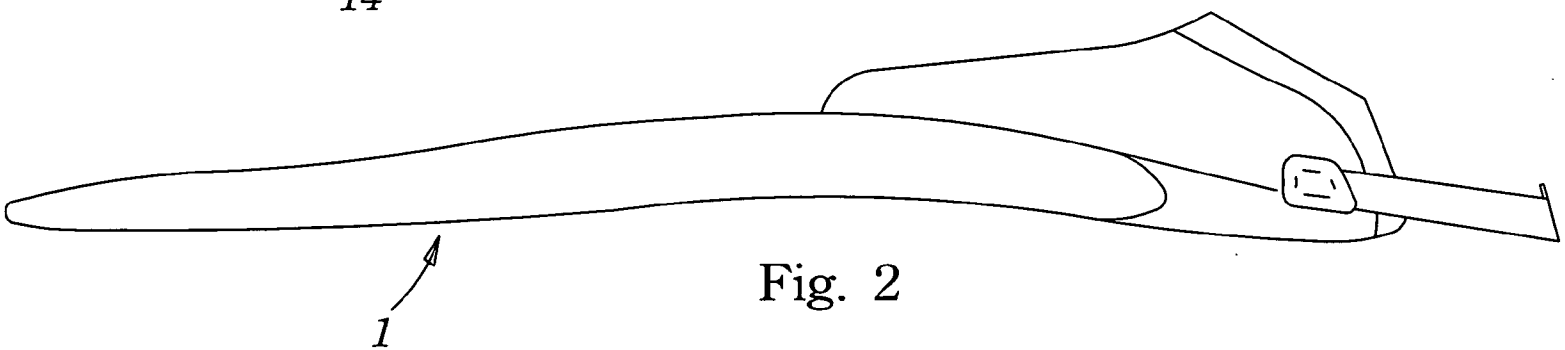
FIG. 2 is a side view of the fin of FIG. 1.

Please refer to FIGS. 1 and 2 that are top plan and side views, respectively, of a fin with a blade having adjustable closed area according to the present invention.

As shown, the fin mainly includes a blade 1, and at least one zipper 2.

Figure 3:
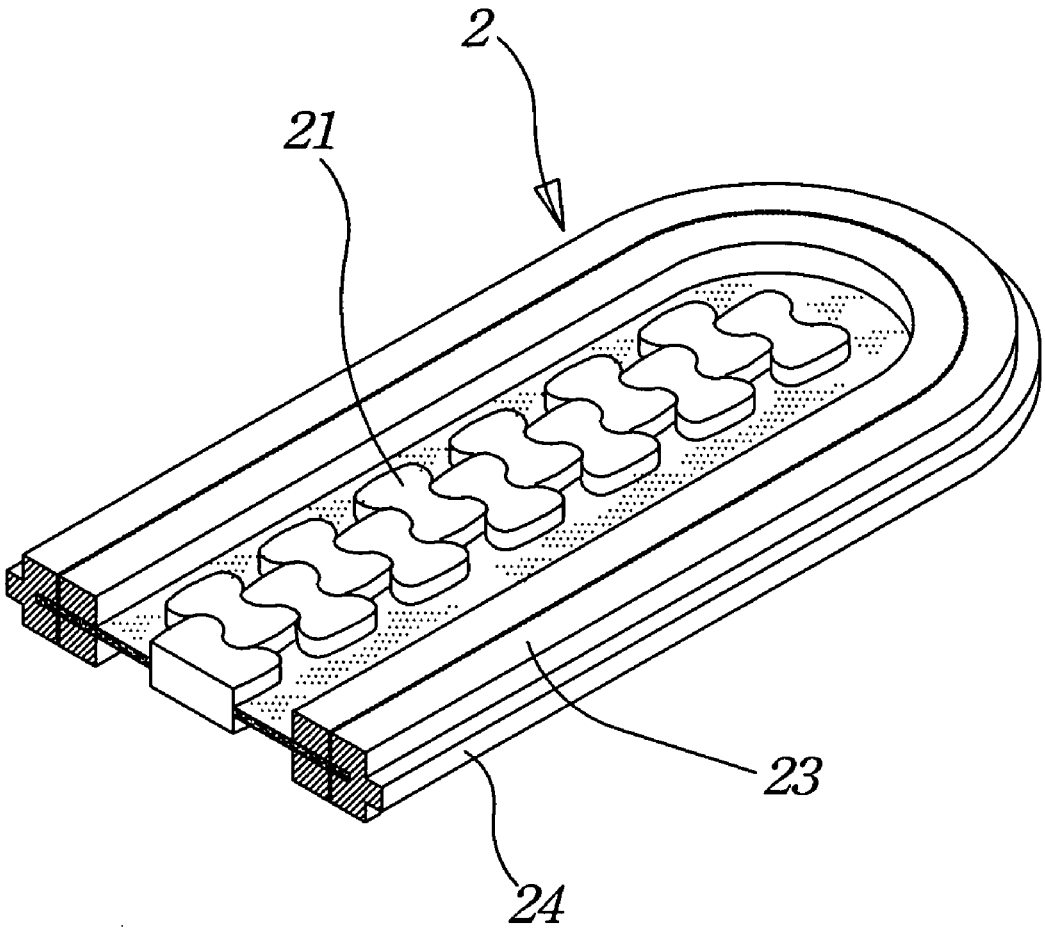
FIG. 3 is a fragmentary perspective view of a zipper included in the fin of the present invention.
Figures 4, 5:
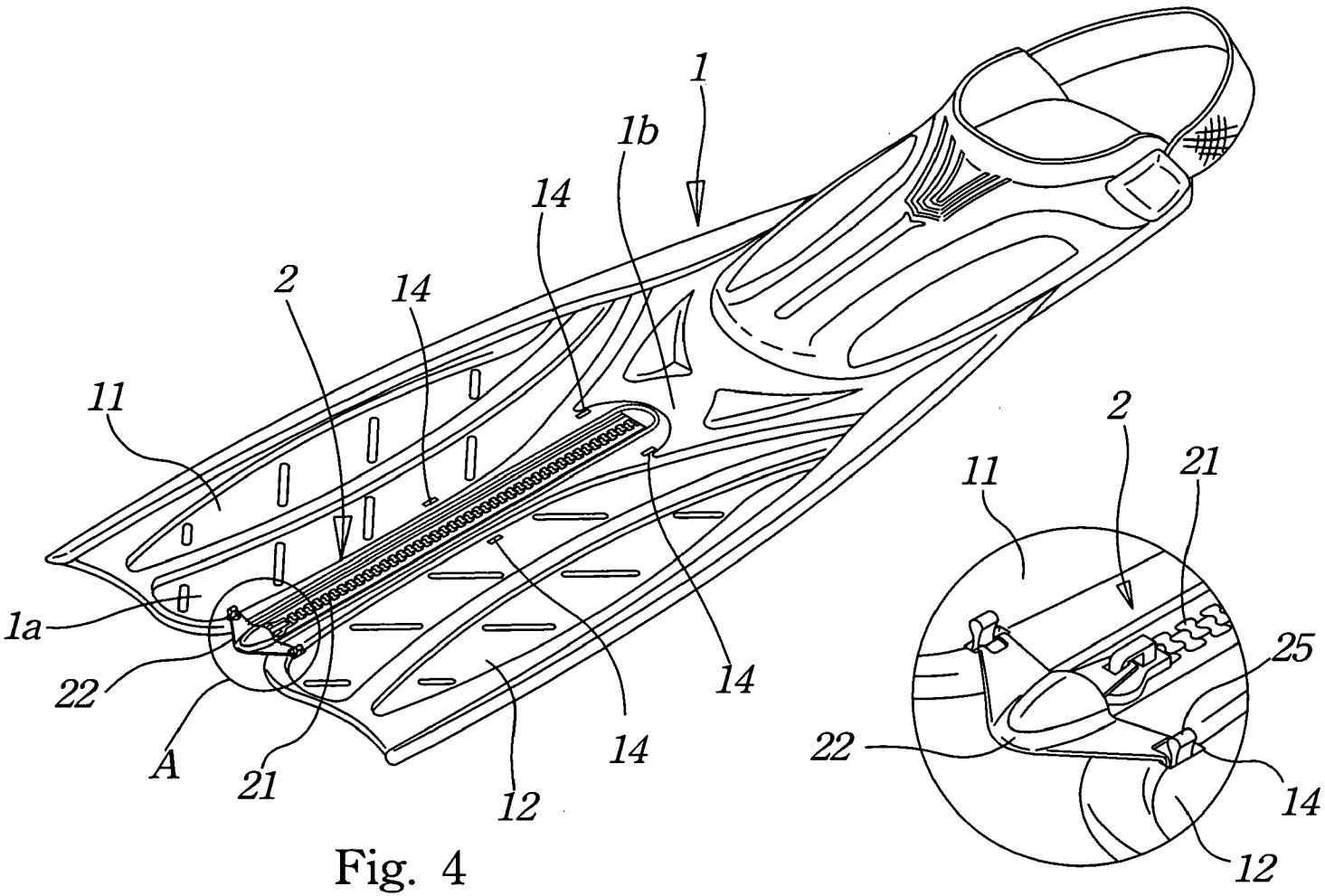
FIG. 4 is a top perspective view of FIG. 1.
FIG. 5 is an enlarged view of the circled area A of FIG. 4.

The blade 1 is lengthwise split into a plurality of sub-blades, so that these sub-blades are separated from one another from an outer end 1*a* of the blade 1 to a near central point 1*b* of the blade 1 (also see FIG. 3). In the illustrated embodiment, the blade 1 is split into two sub-blades, namely, a left and a right sub-blade 11, 12. And, the following description is made based on a blade 1 having two sub-blades.

Please refer to FIGS. 1 and 3–5, the zipper 2 is located between the adjacent left and right sub-blades 11, 12, and mainly includes two toothed zipper tapes 21 that may be closed to or separated from each other using a pull tab 22 connected to a slide of the zipper 2, and a plastic frame 23 sewed to two lateral sides and an inner end of the zipper tapes 21 with an outer periphery of the plastic frame 23 connected to the adjacent left and right sub-blades 11, 12.

The zipper 2 may be connected to the blade 1 in any suitable manner. For example, the zipper 2 may be positioned in a mold used to mold the blade 1, so that the plastic frame 23 of the zipper 2 is integrally connected to the adjacent left and right sub-blades 11, 12.

To ensure firm and stable connection of the zipper 2 to the blade 1, tongue and groove joint may be designed between the plastic frame 23 and the blade 1. For example, as shown in FIG. 7, a flange 24 may be provided along the outer periphery of the plastic frame 23 of the zipper 2, and a groove 13 corresponding to the flange 24 may be provided along adjacent edges of the left and the right sub-blade 11, 12.

Moreover, the blade 1 is provided along the adjacent edges of the left and the right sub-blade 11, 12 at an outer side of the zipper 2 with locating mechanism C, so that the pull tab 22 having been pulled from the outer end 1*a* of the blade 1 to a desired position on the zipper 2 to partially or fully separate the left and the right sub-blade 11, 12 from each other may be held in place via the locating mechanism C and thereby keeps the two sub-blades 11, 12 in the separated state.

Figure 6:
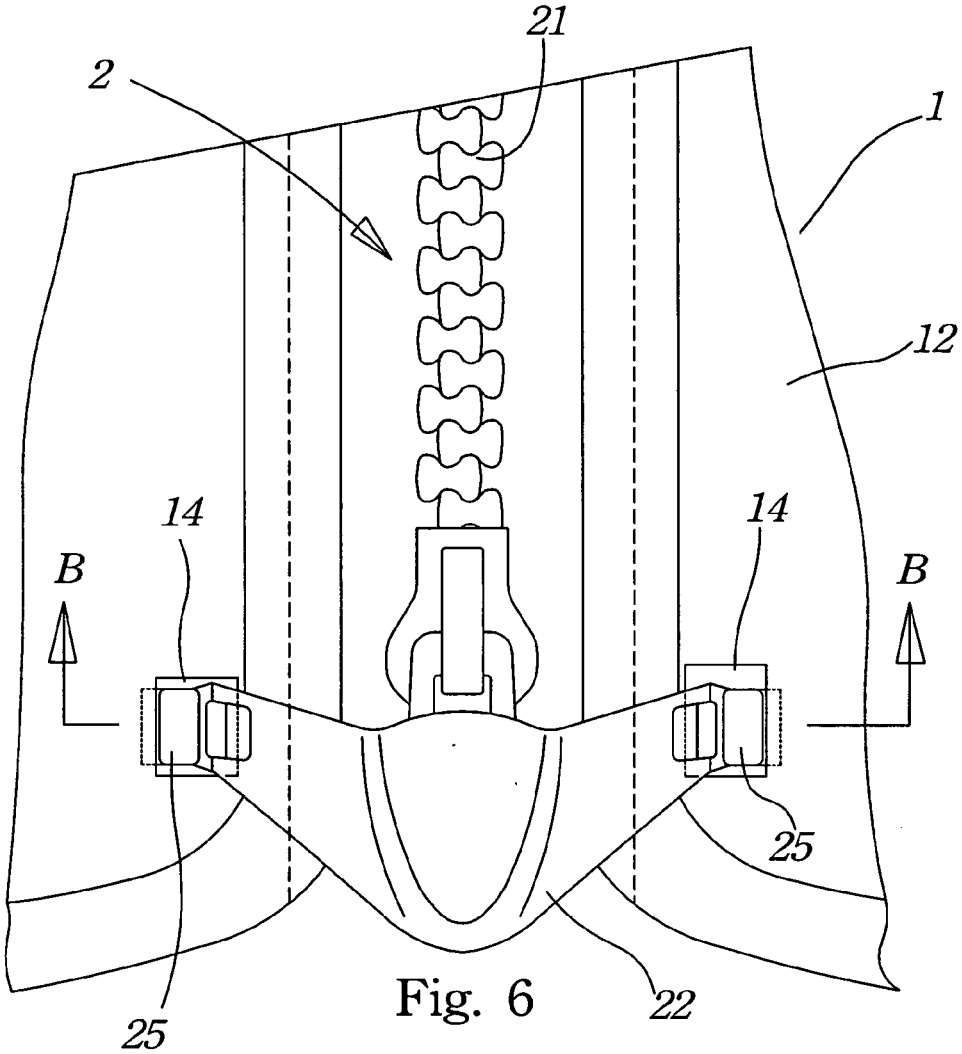
FIG. 6 is a fragmentary and enlarged plan view of the fin of the present invention showing the structure of the zipper at an outer end thereof.
Figure 7:
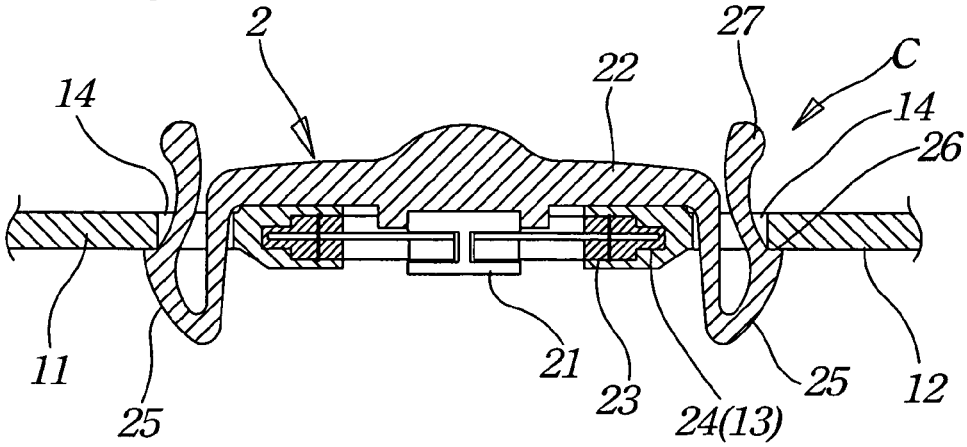
FIG. 7 is a cross sectional view taken along line B—B of FIG. 6 showing the engagement of a pull tab of the zipper with a pair of locating holes on the blade of the fin.

FIGS. 6 and 7 clearly shows the engagement of the pull tab 22 with the locating mechanism C. As shown, the locating mechanism C includes a plurality of pairs of locating holes 14 provided along the adjacent edges of the left and the right sub-blade 11, 12 from the outer end 1*a* of the blade 1 to the near central point 1*b* of the blade 1; and two substantially U-shaped holding ears 25 downward extended from two lateral sides of the pull tab 22. The U-shaped holding ears 25 are provided at respective lower outer wall surface with a shoulder portion 26 adapted to elastically engage with a lower edge of the locating hole 14, and thereby hold the pull tab 22 of the zipper 2 to a fixed position defined by one pair of locating holes 14. Once the pull tab 22 is engaged with one selected pair of locating holes 14 and held in place, the zipper 2 is stopped from opening or closing. Upper ends of the outer wall surfaces of the U-shaped holding ears 25 are formed into two pressing arms 27, which are normally upward projected from the locating holes 14 and easily accessible by a diver.

Figure 8:
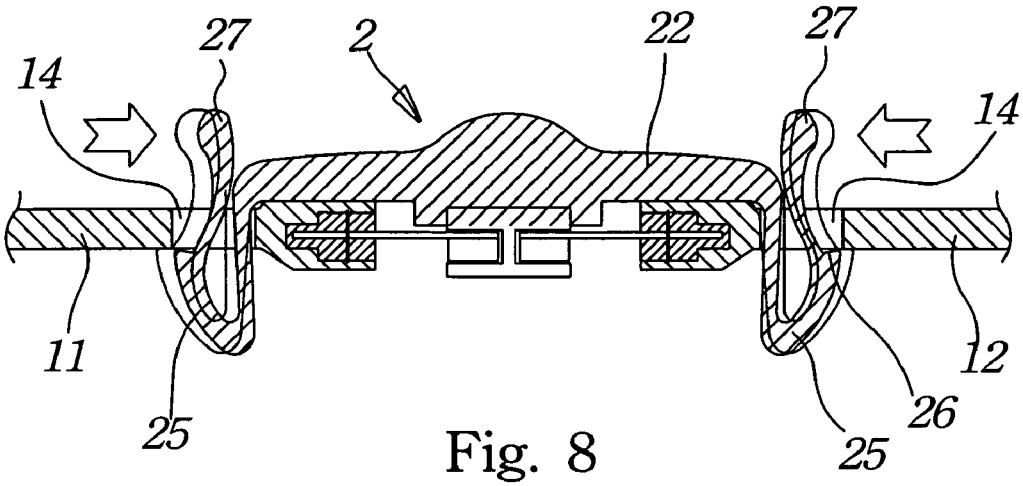
FIG. 8 shows the first step of releasing the pull tab of the zipper from the locating holes on the blade of the fin.
Figure 9:
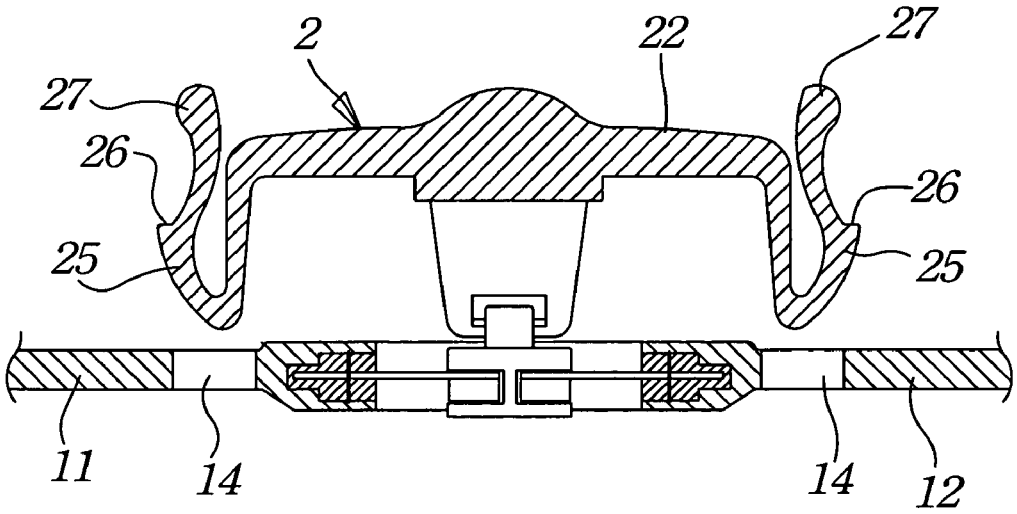
FIG. 9 shows the second step of releasing the pull tab of the zipper from the locating holes on the blade of the fin.
Figure 10:
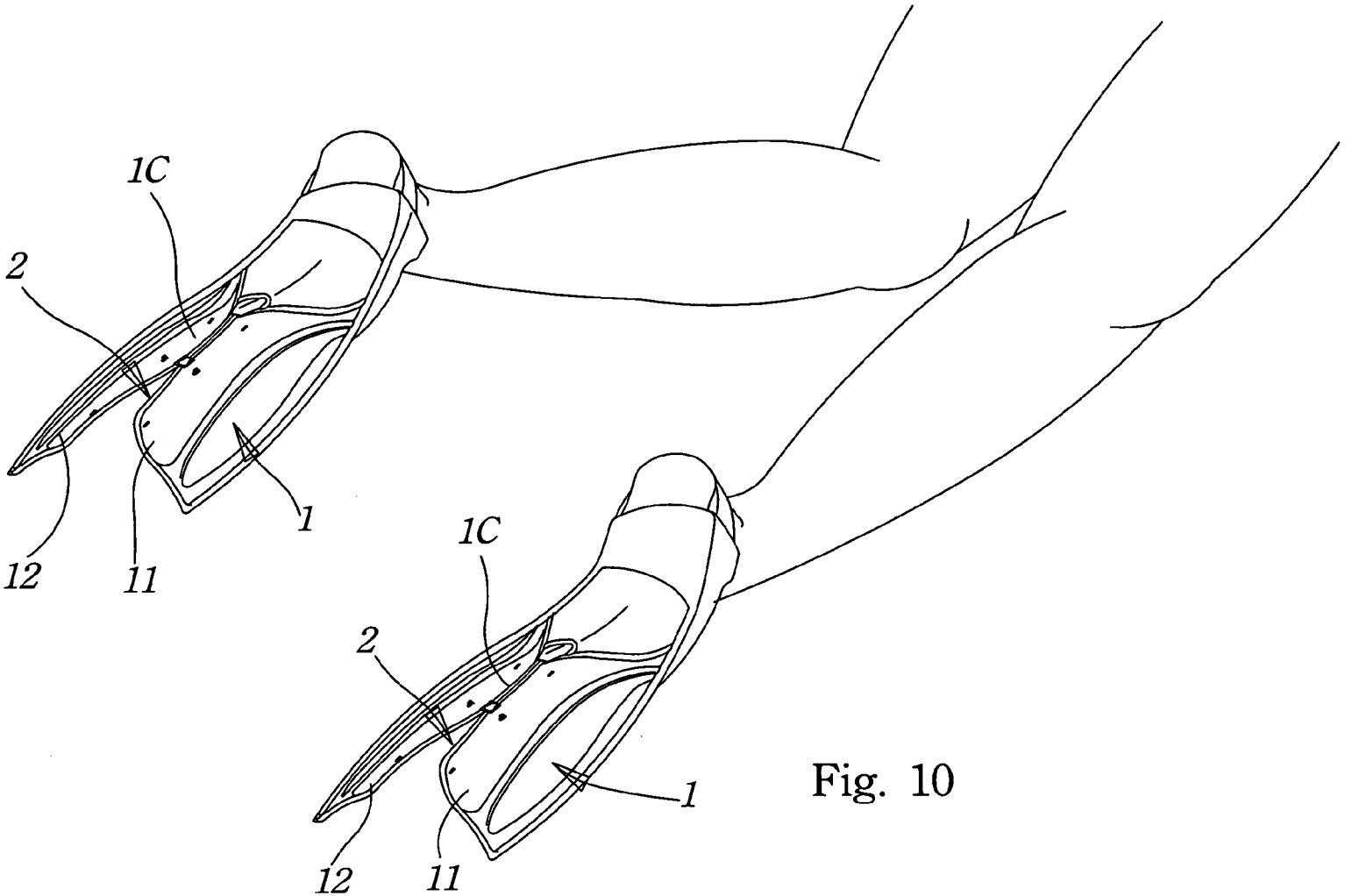
FIG. 10 shows the use of the fin of the present invention with the blade in a half closed state.

Please refer to FIGS. 8 and 9. When it is desired to release the pull tab 22 from the locating holes 14, simply press the two pressing arms 27 toward each other to disengage the shoulder portions 26 from the lower edges of the locating holes 14, and then pull the pull tab 22 upward to completely separate the U-shaped holding ears 25 from the locating holes 14. At this point, the pull tab 22 may be pulled again to open or close the toothed zipper tapes 21 and be located at another desired pair of locating holes 14. FIG. 10 shows the zipper 2 on the blade 1 of the fin of the present invention is pulled to half open the blade 1.

When the pull tab 22 is pulled forward from the near central point 1*b* toward the outer end 1*a* of the blade land engaged with one selected pair of locating holes 14, portions of the two adjacent sub-blades 11, 12 behind the pull tab 22 are zippered up to produce a closed area 1C. By moving the pull tab 22 to different positions, the closed area 1C is adjusted to accordingly regulate a propulsive force that may be produced by the fin.

According to the present invention, the zipper 2 for regulating the propulsive force of the fin is integrally provided on the blade 1 without the risk of undesirably separating from the blade 1. What is most important is a user (diver) may adjust the zippered-up length of the zipper 2 and accordingly regulate the propulsive force of the fin at any time before or during diving, so as to enable kicking water in the most comfortable manner. That is, the fin of the present invention may be conveniently and quickly adjusted without the risk of scattered parts.

What is claimed is:

1. A fin with a blade having adjustable closed area, comprising:

a blade being lengthwise split into a plurality of sub-blades, so that said sub-blades are separated from one another from an outer end of said blade to a near central point of said blade; and at least one zipper being located between two said sub-blades that are adjacent to each other, said zipper being adapted to zip up for said adjacent sub-blades to provide a closed area, and said closed area being adjustable by zipping up said zipper by different length to thereby regulate a propulsive force that may be produced by said blade of said fin, wherein said zipper includes;

two toothed zipper tapes that may be closed or separated from each other; a pull tab connected to said toothed zipper tapes for closing or separating said two zipper tapes; and a plastic frame connected to two lateral sides and an inner end of said zipper tapes with an outer periphery of said plastic frame connected to two adjacent edges of said two adjacent sub-blades, and wherein said plastic frame is provided along the outer periphery with a flange, and said adjacent sub-blades are provided along the adjacent edges with a groove corresponding to said flange.

2. The fin with a blade having adjustable closed area as claimed in claim 1, wherein said zipper is connected to said blade by positioning said zipper in a mold used to mold said blade, so that said plastic frame of said zipper is integrally connected to said two adjacent sub-blades.

3. The fin with a blade having adjustable closed area as claimed in claim 1, wherein said toothed zipper tapes are connected to said plastic frame by sewing.

4. The fin with a blade having adjustable closed area as claimed in claim 1, further comprising a locating mechanism provided between said zipper and said adjacent sub-blades.

5. A fin with a blade having adjustable closed area, comprising:

a blade being lengthwise split into a plurality of sub-blades, so that said sub-blades are separated from one another from an outer end of said blade to a near central point of said blade; and at least one zipper being located between two said sub-blades that are adjacent to each other, said zipper being adapted to zip up for said adjacent sub-blades to provide a closed area, and said closed area being adjustable by zipping up said zipper by different length to thereby regulate a propulsive force that may be produced by said blade of said fin, wherein said zipper includes:

two toothed zipper tapes that may be closed or separated from each other; a pull tab connected to said toothed zipper tapes for closing or separating said two zipper tapes; and a plastic frame connected to two lateral sides and an inner end of said zipper tapes with an outer periphery of said plastic frame connected to two adjacent edges of said two adjacent sub-blades, a locating mechanism provided between said zipper and said adjacent sub-blades and wherein said locating mechanism includes a plurality of pairs of locating holes provided along said adjacent edges of said adjacent sub-blades from the outer end of said blade to the near central point of said blade; and two holding ears downward extended from two lateral sides of said pull tab; and said holding ears being adapted to detachably connect to any selected pair of said locating holes.

6. The fin with a blade having adjustable closed area as claimed in claim 5, wherein said holding ears are substantially U-shaped, and each of said holding ears is provided near a lower outer wall surface with a shoulder portion adapted to elastically engage with a lower edge of said locating hole.

7. The fin with a blade having adjustable closed area as claimed in claim 6, wherein each of said U-shaped holding ears has an upper outer end formed into a pressing arm that is normally upward projected from said locating hole.

* * * * *